US010145263B2

(12) United States Patent
Rodriguez Erdmenger et al.

(10) Patent No.: US 10,145,263 B2
(45) Date of Patent: Dec. 4, 2018

(54) MOVEABLE NOZZLE ASSEMBLY AND METHOD FOR A TURBOCHARGER

(71) Applicant: General Electric Company, Schenectady, NY (US)

(72) Inventors: Rodrigo Rodriguez Erdmenger, Garching b. Munich (DE); Sebastian Walter Freund, Garching b. Munich (DE); Ismail Hakki Sezal, Garching BY (DE); Aneesh Sridhar Vadvadgi, Bangalore (IN)

(73) Assignee: General Electric Company, Schenectady, NY (US)

( * ) Notice: Subject to any disclaimer, the term of this patent is extended or adjusted under 35 U.S.C. 154(b) by 389 days.

(21) Appl. No.: 15/155,823

(22) Filed: May 16, 2016

(65) Prior Publication Data

US 2017/0328234 A1 Nov. 16, 2017

(51) Int. Cl.

| | |
|---|---|
| ***F01D 17/14*** | (2006.01) |
| ***F01D 9/04*** | (2006.01) |
| ***F01D 25/24*** | (2006.01) |
| ***F02B 33/40*** | (2006.01) |
| ***F02B 39/16*** | (2006.01) |

(52) U.S. Cl.

CPC ..... *F01D 17/141* (2013.01); *F01D 9/045* (2013.01); *F01D 25/24* (2013.01); *F02B 33/40* (2013.01); *F02B 39/16* (2013.01); *F05D 2220/40* (2013.01); *F05D 2240/128* (2013.01)

(58) Field of Classification Search

CPC ..... F01D 17/148; F01D 17/17; F01D 17/141; F01D 9/042; F05D 2250/90; F05D 2240/128; F02B 37/22

See application file for complete search history.

(56) References Cited

U.S. PATENT DOCUMENTS

| | | | | |
|---|---|---|---|---|
| 6,260,358 | B1 * | 7/2001 | Daudel | F02B 37/02 415/42 |
| 7,137,778 | B2 | 11/2006 | Marcis et al. | |
| 8,267,647 | B2 | 9/2012 | Scholz et al. | |
| 9,021,803 | B2 * | 5/2015 | Hirth | F01D 17/141 415/158 |

(Continued)

OTHER PUBLICATIONS

Srithar et al., "Variable Geometry Mixed Flow Turbine for Turbochargers: An Experimental Study", International journal of fluid machinery and systems; vol. 1, Issue No. 1, pp. 155-168.

*Primary Examiner* — Ninh H Nguyen

(74) *Attorney, Agent, or Firm* — GE Global Patent Operation; Pabitra K. Chakrabarti

(57) ABSTRACT

A nozzle assembly of a turbocharger includes a nozzle and a ring-shaped body. The nozzle has flow passages extending through the nozzle and configured to direct air received from a volute housing of the turbocharger through the nozzle to turbine blades of the turbocharger. The ring-shaped body is coupled with the nozzle and is configured to rotate around the nozzle. The ring-shaped body includes blocking segments that block the flow of the air and openings between the blocking segments that permit the air to flow through the ring-shaped body. The ring-shaped body is configured to rotate relative to the nozzle to change how many of the flow passages in the nozzle are blocked by the blocking segments of the ring-shaped body.

20 Claims, 7 Drawing Sheets

(56) References Cited

U.S. PATENT DOCUMENTS

| | | | | |
|---|---|---|---|---|
| 9,032,727 | B2 | 5/2015 | Gupta et al. | |
| 9,194,257 | B2 | 11/2015 | Keny et al. | |
| 9,291,092 | B2 * | 3/2016 | Sumser | F01D 17/105 |
| 9,388,706 | B2 * | 7/2016 | Kitzmiller | F03B 3/183 |
| 2010/0150701 | A1 | 6/2010 | Simon et al. | |
| 2014/0086725 | A1 | 3/2014 | Shi | |
| 2015/0000268 | A1 | 1/2015 | Clancy et al. | |

* cited by examiner

MOVEABLE NOZZLE ASSEMBLY AND METHOD FOR A TURBOCHARGER

FIELD

The subject matter described herein relates to turbochargers.

BACKGROUND

Variable geometry turbochargers include turbines that move to change the output of the turbochargers. The moveable turbines address the power needs of the turbochargers at part load operation. For example, as the load placed on the engine that is partially powered by the turbocharger changes, each of the turbines or blades of the turbocharger can move to change the speed at which the turbocharger rotates. This change in rotational speed changes how much air is forced into the engine, thereby changing how much power is generated by the engine.

This type of turbine design avoids the need of using waste gates and can improve engine efficiency by reducing pumping losses associated with an undersized turbine on air handling systems. The variable geometry turbochargers, however, also are expensive and less reliable than other turbochargers due to the large number of moving components.

BRIEF DESCRIPTION

In one embodiment, a nozzle assembly of a turbocharger includes a nozzle and a ring-shaped body. The nozzle has flow passages extending through the nozzle and configured to direct air received from a volute housing of the turbocharger through the nozzle to turbine blades of the turbocharger. The ring-shaped body is coupled with the nozzle and is configured to rotate around the nozzle. The ring-shaped body includes blocking segments that block the flow of the air and openings between the blocking segments that permit the air to flow through the ring-shaped body. The ring-shaped body is configured to rotate relative to the nozzle to change how many of the flow passages in the nozzle are blocked by the blocking segments of the ring-shaped body.

In one embodiment, an airflow restriction body of a turbocharger includes a first ring, a second ring, and blocking segments. The first ring is configured to be coupled with a nozzle of the turbocharger. The second ring is configured to be coupled with the nozzle of the turbocharger, and is spaced apart from the first ring in a direction that is parallel to a center axis of the nozzle of the turbocharger. The blocking segments extend from the first ring to the second ring and spaced apart from each other by openings. The first and second rings and the blocking segments are configured to rotate around the nozzle of the turbocharger to change which flow passages of the nozzle through which air flows from a volute housing of the turbocharger to blades of the turbocharger are open and which of the flow passages are closed.

In one embodiment, a method includes determining a load placed on one or more of an engine or a turbocharger operatively coupled with the engine and rotating a ring-shaped body around a nozzle of the turbocharger based on the load that is determined. The ring-shaped body has blocking segments that block at least some flow passages of the nozzle through which air flows from a volute housing of the turbocharger to blades of the turbocharger and openings that allow the air to flow from the volute housing of the turbocharger to the blades of the turbocharger. Rotation of the ring-shaped body blocks the air from flowing through at least some of the flow passages in the nozzle with the blocking segments of the ring-shaped body.

BRIEF DESCRIPTION OF THE DRAWINGS

The present inventive subject matter will be better understood from reading the following description of non-limiting embodiments, with reference to the attached drawings, wherein below.

DETAILED DESCRIPTION

The inventive subject matter described herein provides a nozzle assembly for a turbocharger than includes a ring-shaped body that can rotate around a nozzle of a turbocharger to cover one or more flow passages of the nozzle. This can significantly reduce the number and complexity of the moving parts in the turbocharger relative to some known variable geometry turbochargers, while still providing the flexibility to change the amount of air flowing through the nozzle based on the load placed on the engine receiving air from the turbocharger. The nozzle assembly may be used in fixed geometry turbochargers, or turbochargers having blades or turbines that are fixed in relative positions to each other, to permit fixed geometry turbochargers to change the air flow through the nozzles in the turbochargers in response to changing loads placed on the engines connected with the turbochargers.

Figure 1:
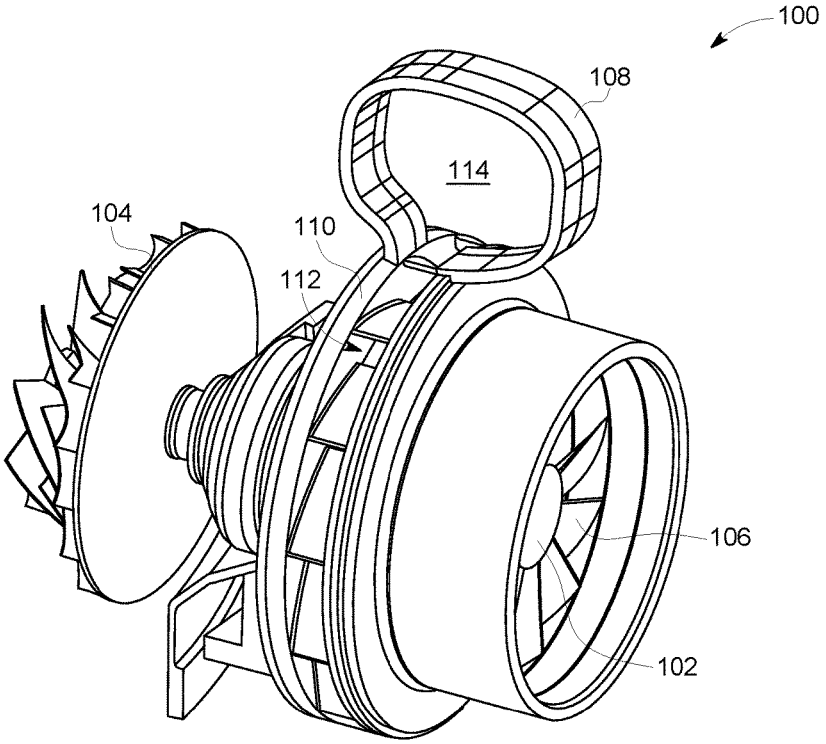
FIG. 1 illustrates a cut-away view of a fixed geometry turbocharger according to one embodiment.

FIG. 1 illustrates a cut-away view of a fixed geometry turbocharger 100 according to one embodiment. The turbocharger 100 includes a turbine wheel 102 that rotates in response to receiving airflow. The turbine wheel 102 is connected with a compressor wheel 104 by a shaft (not shown). The turbine wheel 102 includes turbines or blades 106 that cause the turbine wheel 102, compressor wheel 104, and shaft to rotate. A portion of a volute housing 108 is shown in FIG. 1. The volute housing 108, or volute, circumferentially extends around at least part of the turbine wheel 102. A nozzle 110 is disposed concentrically between the volute housing 108 and the turbine wheel 102. The nozzle 110 includes flow passages 112 through which air flows from a volume 114 defined by the volute housing 108 and the turbine wheel 102. The turbocharger 100 may be a fixed geometry turbocharger 100 in that the turbine blades 106 do not individually rotate or move relative to each other. Instead, all of the turbine blades 106 are fixed in position relative to each other and rotate together.

Figure 2:
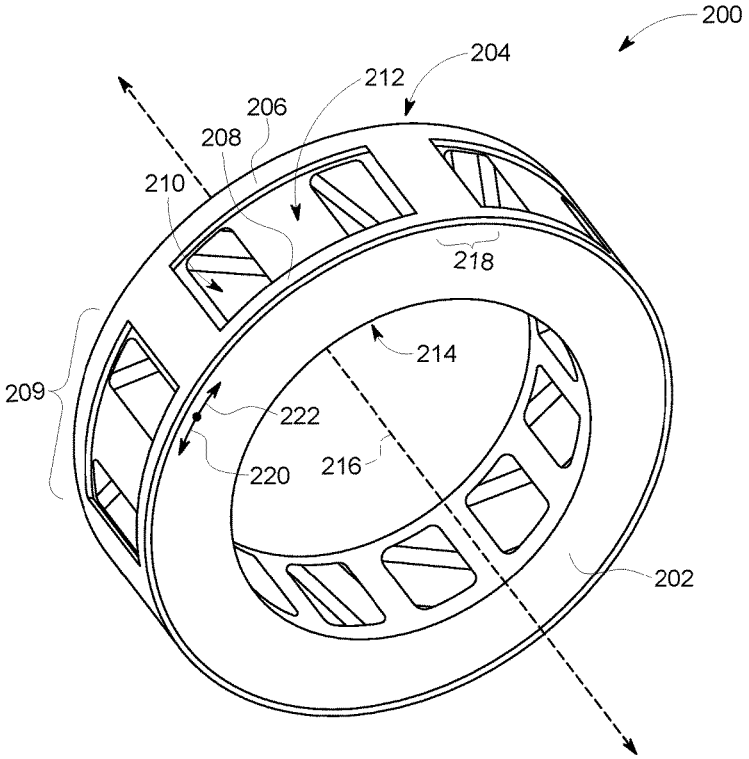
FIG. 2 illustrates one embodiment of a nozzle assembly for a turbocharger.

FIG. 2 illustrates one embodiment of a nozzle assembly 200 for a turbocharger. The nozzle assembly 200 may be used in place of the nozzle 110 in the turbocharger 100 shown in FIG. 1. The nozzle assembly 200 includes a nozzle 202 having flow passages 210 extending through the nozzle 202. The nozzle 202 has a ring-shape with opposite outer and inner surfaces 212, 214. The nozzle 202 and surfaces 212, 214 extend around or encircle a center axis 215 of the nozzle 202 and nozzle assembly 200. The center axis 215 may be identical to the center axis (not shown) of the turbine wheel 102 in the turbocharger 100 (shown in FIG. 1).

The flow passages 210 are openings or ports that extend through the nozzle 202 from the outer surface 212 to the inner surface 214 to allow and direct air to flow through the nozzle 202 from the volume 114 (shown in FIG. 1) defined by the volute housing 108 (shown in FIG. 1) to the turbines 106 (shown in FIG. 1) of the turbine wheel 102 (shown in FIG. 1).

A ring-shaped body 204 is coupled with the nozzle 202. The ring-shaped body 204 may be connected with the nozzle 202 and be able to move along the outer surface 212 of the nozzle 202. For example, the ring-shaped body 204 can extend along and around the outer surface 212 of the nozzle 202 and be able to slide along the outer surface 212 of the nozzle 202 around the center axis 216. Similar to the nozzle 202, the ring-shaped body 204 extends around and encircles the center axis 216.

The ring-shaped body 204 includes first and second rings 206, 208 that are axially spaced apart from each other in directions that are parallel to the center axis 216. The rings 206, 208 may have the same shape as the outer surface 212 of the nozzle 202, but be slightly larger along radial directions from the center axis 216 than the outer surface 212 of the nozzle 202 to permit the ring-shaped body 204 to move outside of the nozzle 202, such as by sliding along the outer surface 212 of the nozzle 202 along one or more circumferential directions 220, 222 that are parallel to the outer circumference or perimeter of the outer surface 212 of the nozzle 202.

The ring-shaped body 204 includes blocking segments 218 that extend between the rings 206, 208 of the ring-shaped body 204. For example, the blocking segments 218 may be formed from solid bodies or continuations of the rings 206, 208 that extend from one ring 206 or 208 to the other ring 208 or 206 along axial directions that are parallel to the center axis 216. The blocking segments 218 also partially extend in transverse (e.g., perpendicular) directions, such as directions that are parallel to the circumferential directions 220, 222.

The blocking segments 218 are separated from each other by gaps along the circumferential directions 220, 222 to define open segments, or openings 209, in the ring-shaped body 204. As shown in FIG. 2, the rings 208, 208 and the blocking segments 218 extend around, or frame, the openings 209 of the ring-shaped body 204. In the illustrated embodiment, the blocking segments 218 and openings 209 form an alternating sequence along the circumferential directions 220, 222 in the ring-shaped body 204.

The ring-shaped body 204 can be moved relative to the nozzle 202 to position one or more of the blocking segments 218 over the flow passages 210 in the nozzle 202. The blocking segments 218 that are positioned over the flow passages 210 block the flow of air into those flow passages 210 and through the nozzle 202 to the turbines 106 (shown in FIG. 1) of the turbocharger 100. The openings 209 defined by the ring-shaped body 204 that are positioned over the flow passages 210 of the nozzle 202 allow the air to flow through the openings 209 and into the flow passages 210 to the turbines 106 of the turbocharger 100.

Figure 3:
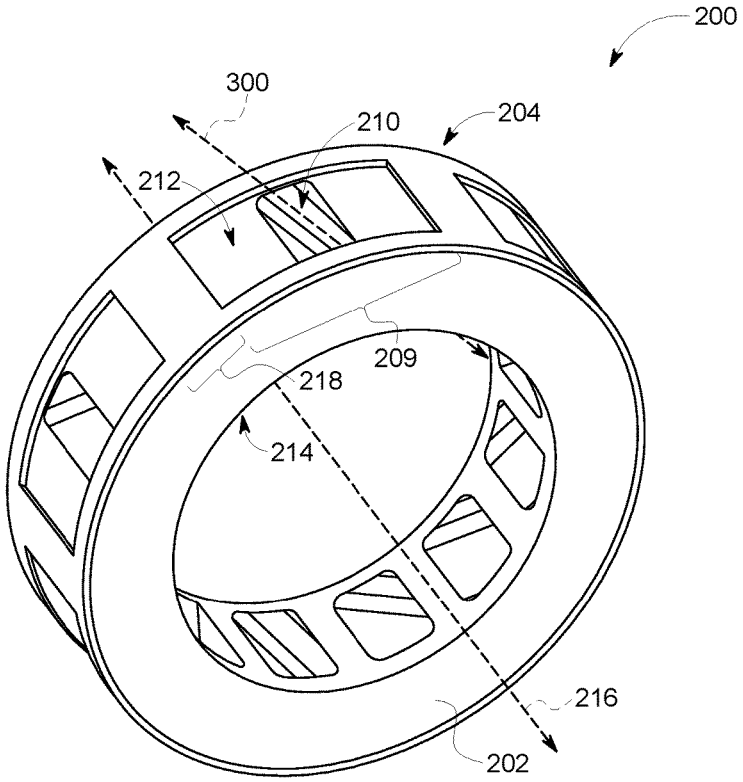
FIG. 3 illustrates the nozzle assembly shown in FIG. 2 in a different position relative to a nozzle also shown in FIG. 2.

FIG. 3 illustrates the nozzle assembly 200 shown in FIG. 2 in a different position relative to the nozzle 202 shown in FIG. 2. The ring-shaped body 204 can be rotated around the nozzle 202 to change the positions of the blocking segments 218 and the openings 209 in the ring-shaped body 204 relative to the flow passages 210 in the nozzle 202. As a result, the amount of air flowing from the volume 114 (shown in FIG. 1) defined by the volute housing 108 (shown in FIG. 1) and the turbine wheel 102 (shown in FIG. 1) of the turbocharger 100 (shown in FIG. 1), through the flow passages 210 in the nozzle 202, and to the turbines 106 (shown in FIG. 1) of the turbocharger 100 (shown in FIG. 1) can be at least partially controlled by movement of the ring-shaped body 204 relative to the nozzle 202.

For example, in the state or position of the ring-shaped body 204 in FIG. 2 (relative to the nozzle 202), the blocking segments 218 of the ring-shaped body 204 are positioned between the flow passages 210 in the nozzle 202 and the openings 209 in the ring-shaped body 204 are located over the flow passages 210. The blocking segments 218 in the ring-shaped body 204 in these locations do not block air from flowing into and through the flow passages 210 in the nozzle 202. As a result, more air is able to flow through the turbocharger 100 and to the engine connected with the turbocharger 100.

But, rotation of the ring-shaped body 204 from the position shown in FIG. 2 to the position shown in FIG. 3 causes the blocking segments 218 in the ring-shaped body 204 to be positioned over some (e.g., half or another fraction) of the flow passages 210 in the nozzle 202. The openings 209 in the ring-shaped body 204 are located over some, but not all, of the flow passages 210. The blocking segments 218 in the ring-shaped body 204 in these locations block at least some of the air from flowing into and through the flow passages 210 in the nozzle 202. For example, the ring-shaped body 204 in this position may block half of the air flowing through the nozzle 202 in the position shown in FIG. 2 from flowing through the nozzle 202. As a result, less air is able to flow through the turbocharger 100 and to the engine connected with the turbocharger 100.

In the illustrated embodiment, the blocking segments 218 are the same size as each other and the openings 209 are the same size as each other. Alternatively, two or more blocking segments 218 may have different sizes and/or two or more of the openings 209 may have different sizes. This can result in the blocking segments 218 blocking less or more of one or more of the flow passages 210 in the nozzle 202. Additionally, in the illustrated embodiment, the ring-shaped body 204 is disposed on and moves along the outer surface 212 of the nozzle 202. Alternatively, the ring-shaped body 204 may be disposed on and move along the inner surface 214 of the nozzle 202. Placing the body 204 on the inner surface 214 may reduce inlet losses.

The flow passages 210 extending through the nozzle 202 may be the same size (or approximately the same size, such as where differences in size are within manufacturing tolerances of the nozzle 202). The flow passages 210 may be centered around or on, and be elongated along, directions 300 (shown in FIG. 3) that are transverse to radial directions of the center axis 216 (e.g., non-radial directions) and that are not tangential to the outer or inner surfaces 212, 214 of the nozzle 202. Additionally the flow passages may be aerodynamically shaped to reduce the flow losses through the passage by applying rounded leading edges and/or camber to the cross sectional area. A flow passage 210 is centered on a direction 300 when the interior surface of the nozzle 202 around the flow passage 210 (the surface of the nozzle 202 that defines the shape and size of the flow passage 210) has opposing sides that are equidistant from the direction 300 or has all sides that are equidistant from the direction 300.

In one embodiment, the directions 300 along which the flow passages 210 are centered and extend along are oriented at the same angle with respect to the outer surface 212 of the nozzle 202 and/or are oriented at the same angle with respect to the inner surface 214 of the nozzle 202. For example, the flow passages 210 may all direct air along paths having the same orientation relative to the nozzle 202.

Figure 4:
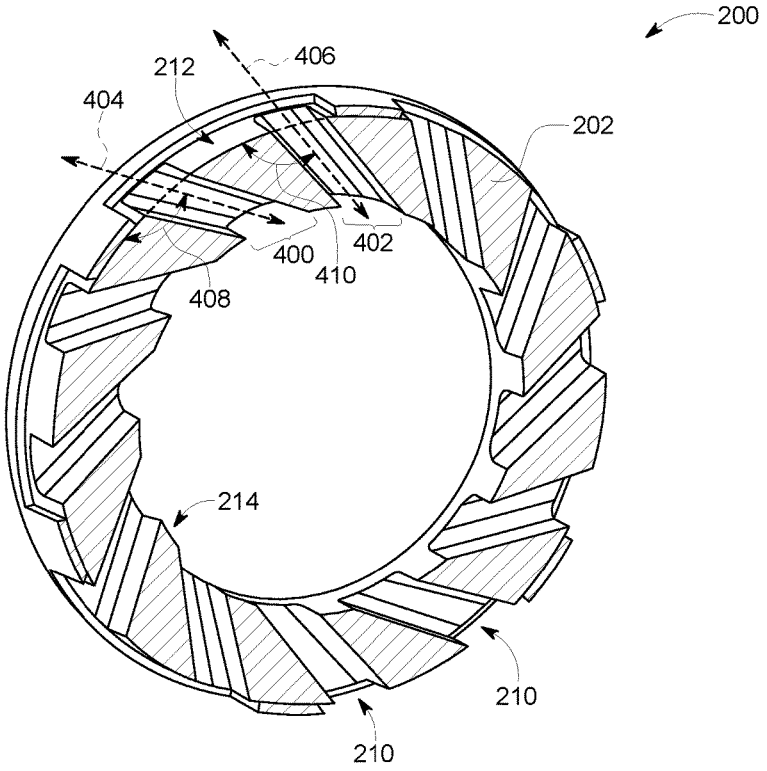
FIG. 4 illustrates a cross-sectional view of one embodiment of the nozzle assembly shown in FIGS. 2 and 3.

FIG. 4 illustrates a cross-sectional view of one embodiment of the nozzle assembly 200 shown in FIGS. 2 and 3. This view of the nozzle assembly 200 shows the shape of the flow passages 210 through the nozzle 202. As shown in FIG. 4, the flow passages 210 include flow passages 400, 402 that are oriented at different angles with respect to the outer surface 212 of the nozzle 202. The flow passages 400, 402 are oriented at different angles with respect to the outer and/or inner surfaces 212, 214 of the nozzle 202.

For example, the flow passages 400 are centered on and elongated along first directions or axes 404 and the flow passages 402 are centered on and elongated along different, second directions or axes 406. The first directions 404 of the flow passages 400 are oriented at obtuse angles 408 with respect to the outer surface 212 of the nozzle 202 and the second directions 406 of the flow passages 402 are oriented at obtuse angles 410 with respect to the outer surface 212 of the nozzle 202. As shown in FIG. 4, the angles 408 at which the directions 404 that the flow passages 400 are oriented with respect to the outer surface 212 of the nozzle 202 are larger than the angles 410 at which the directions 406 that the flow passages 402 are oriented with respect to the outer surface 212 of the nozzle 202.

In the illustrated embodiment, the flow passages 400, 402 alternate with each other around the circumference of the nozzle 202 such that each flow passage 400 has a flow passage 402 on each side of the flow passage 400 and each flow passage 402 has a flow passage 400 on each side of the flow passage 402. Alternatively, a larger number of flow passages 400 and/or 402 may be disposed between pairs of the flow passages 402 and/or 400.

The flow passages 400, 402 having the different orientations may represent different sets of the flow passages 210. The flow passages 400 may be included in one set of the flow passages 210 and the flow passages 402 may be included in a different, second set of the flow passages 210. The blocking segments 218 (shown in FIG. 2) and/or openings 209 (shown in FIG. 2) of the ring-shaped body 204 (shown in FIG. 2) may be positioned to cause the blocking segments 218 to block some or all of the flow passages 210 in one set while not blocking the flow passages 210 in another set when the ring-shaped body 204 is in a first position or location relative to the nozzle 202, and the blocking segments 218 and/or openings 209 of the ring-shaped body 204 may be positioned to cause the blocking segments 218 to block some or all of the flow passages 210 in another, different set while not blocking the flow passages 210 in another set when the ring-shaped body 204 is in a different, second position or location relative to the nozzle 202.

For example, the ring-shaped body 204 may be rotated relative to the nozzle 202 to a first position to cause none of the blocking segments 218 to block the flow of air through any flow passages 210 (or 400, 402). The ring-shaped body 204 may be rotated to a different, second position to cause the blocking segments 218 to block the flow of air through the flow passages 210 in the first set (e.g., the flow passages 400) while not blocking the flow of air through the flow passages 210 in the second set (e.g., the flow passages 402). The ring-shaped body 204 may be rotated to a different, third position to cause the blocking segments 218 to block the flow of air through the flow passages 210 in the second set (e.g., the flow passages 402) while not blocking the flow of air through the flow passages 210 in the first set (e.g., the flow passages 400).

This allows for the ring-shaped body 204 to be used to control the flow of air through the nozzle 202 based on the position of the ring-shaped body 204 relative to the nozzle 202. In the first position described above, more air flows through the nozzle 202 than the second or third positions. In the second position described above, less air flows through the nozzle 202 than the first position, but more air flows through the nozzle 202 than the third position. In the third position described above, less air flows through the nozzle 202 than the first or second positions. More air may flow through the nozzle 202 when the ring-shaped body 204 blocks the flow passages 400, or in other words, the obtuse angle 410 being smaller than the obtuse angle 408. Optionally, the cross-sectional area of the flow passages 400, 402 may be different to allow different amounts of air to flow through the nozzle 200. For example, the flow passages 400 may be wider than the flow passages 402 (or vice-versa) to allow more air to flow through the passages 400 than the passages 402.

Figure 5:
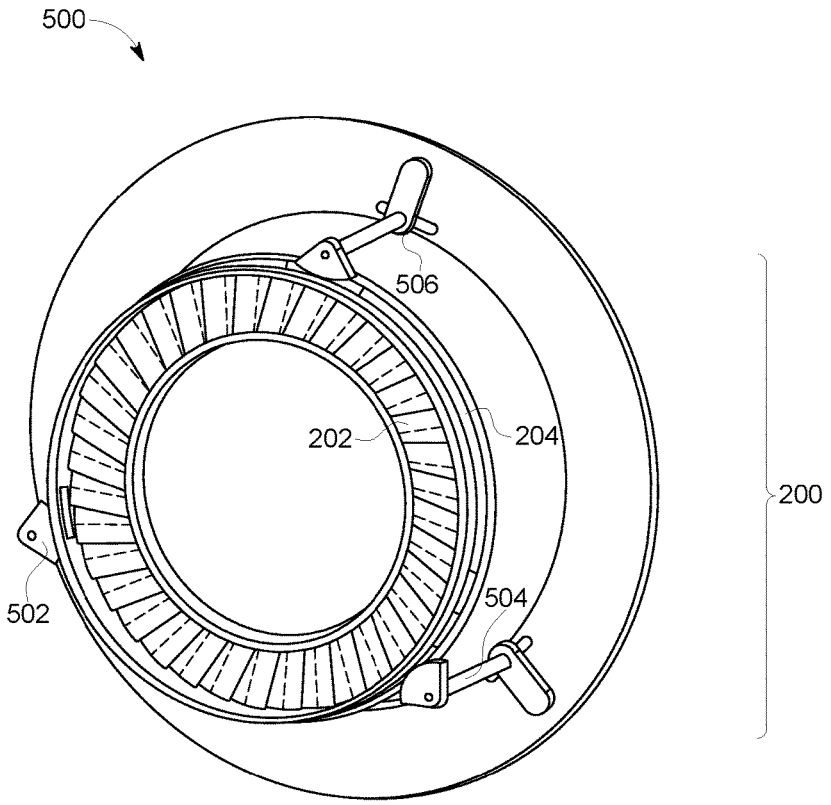
FIG. 5 illustrates a first perspective view of one embodiment of an actuation assembly.
Figure 6:
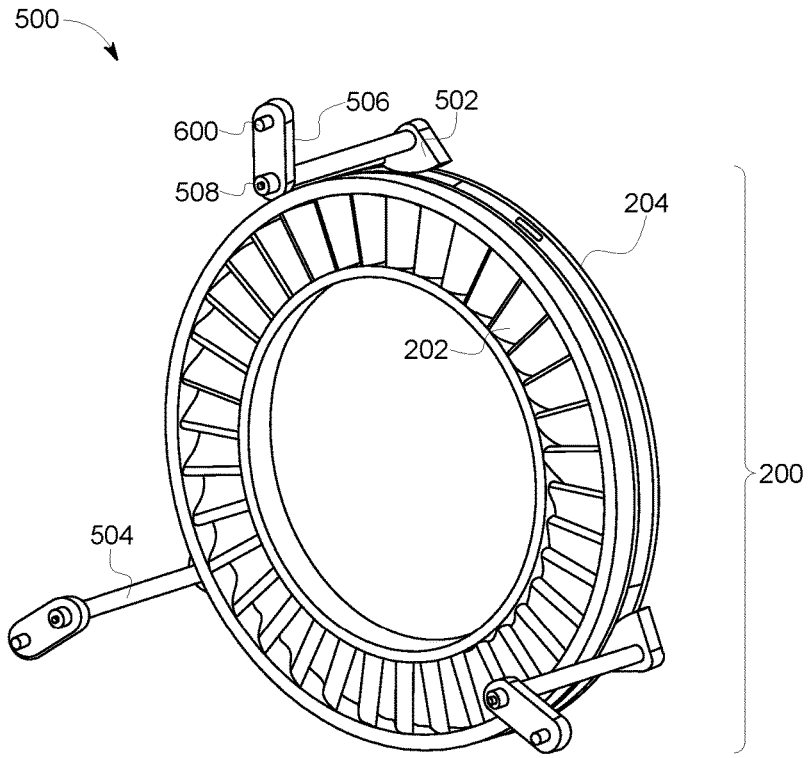
FIG. 6 illustrates a different, second perspective view of the actuation assembly shown in FIG. 5.

FIG. 5 illustrates a first perspective view of one embodiment of an actuation assembly 500. FIG. 6 illustrates a different, second perspective view of the actuation assembly 500 shown in FIG. 5. The actuation assembly 500 may be used to move the ring-shaped body 204 relative to the nozzle 202 in the turbocharger 100 shown in FIG. 1. The actuation assembly 500 moves the ring-shaped body 204 relative to the nozzle 202 to change which, if any, of the flow passages 210 (shown in FIGS. 2 through 4) are blocked by the blocking segments 218 (shown in FIG. 2) of the ring-shaped body 204.

The actuation assembly 500 includes connectors 502 that are coupled with the ring-shaped body 204 in one or more locations. The connectors 502 are coupled with elongated rods 504, which are in turn connected with pivot plates 506. The pivot plates 506 are pivotally connected with a fixed body, such as a part of the housing of the turbocharger 100 that does not move relative to the nozzle 202. The pivot plates 506 include pivot points 600 (shown in FIG. 6) that are connected with the fixed body of the turbocharger 100 and guides 508 that move along corresponding slots in the fixed body, as shown in FIG. 5. The guides 508 and/or other parts of the pivot plates 506 may be connected with a motor or other device capable of moving the pivot points 600. For example, a motor may slide the guides 508 along the slots in the fixed body to cause the pivot plates 506 to at pivot about the pivot points 600.

This pivoting of the pivot plates 506 is converted or translated by the rods 504 and connectors 502 into rotation of the ring-shaped body 204 on the nozzle 202. The actuation assembly 500 may move the ring-shaped body 204 in this manner in order to change which flow passages 210, if any, are blocked to prevent the flow of air there through.

Figure 7:
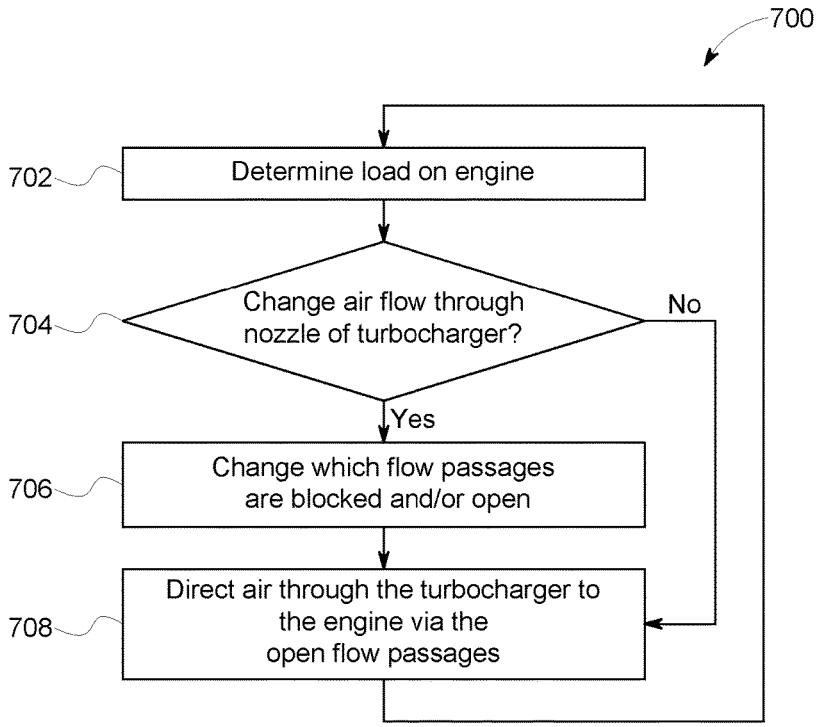
FIG. 7 illustrates a flowchart of one embodiment of a method for controlling airflow through a nozzle of a turbocharger.

FIG. 7 illustrates a flowchart of one embodiment of a method 700 for controlling airflow through a nozzle of a turbocharger. At 702, a load placed on an engine (and/or a turbocharger) is determined. This load can represent an amount of torque, horsepower, or other force that is to be provided by the engine. The load can be determined based on a throttle or pedal position of a vehicle or operating notch on a locomotive, a change in the number of devices that are powered by a generator or alternator connected with the engine, or based on sensor data. At 704, a determination is made as to whether the air flow through the nozzle of the turbocharger to the engine is to be changed. For example, if the load placed on the engine has decreased (e.g., by at least a designated, non-zero amount, such as a drop of 20%, 40%, 50%, or more), then less airflow through the turbocharger to the engine may be needed relative to the load remaining the same, increasing, or decreasing by a lesser amount. As another example, if the load placed on the engine has increased (e.g., by at least a designated, non-zero amount, such as an increase of 20%, 40%, 50%, or more), then more airflow through the turbocharger to the engine may be needed relative to the load remaining the same, decreasing, or increasing by a lesser amount.

If the air flow is to be changed in response to a change in the load, then flow of the method 700 can proceed toward 706. Otherwise, if the air flow is not to change in response to a change in the load, then flow of the method 700 can proceed toward 708. At 706, a change in which flow passages through a nozzle of the turbocharger are open and/or closed is made. For example, if the load has decreased, then more flow passages may be blocked and/or a different set of the flow passages may be blocked to reduce the air flowing through the nozzle to the turbine and to the engine. On the other hand, if the load has increased, then fewer or different flow passages may be blocked or no flow passages may be blocked to increase the air flowing through the nozzle to the turbine and to the engine. The change in which flow passages are blocked or open may be performed by rotating the ring-shaped body relative to the nozzle, as described above.

At 708, air is directed through the turbocharger to the engine via the flow passages that are open. For example, if no flow passages are blocked by the blocking segments of the ring-shaped body, then air may flow through many or all of the flow passages in the nozzle from the volute to the turbines, and then to the engine. If some flow passages are blocked by the blocking segments, then the air may flow through the other flow passages that are not blocked from the volute to the turbines, then to the engine. Flow of the method 700 may return toward 702 or may terminate.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A nozzle assembly of a turbocharger, the assembly comprising:

a nozzle having flow passages extending through the nozzle and configured to direct air received from a volute housing of the turbocharger through the nozzle to turbine blades of the turbocharger; and a ring-shaped body coupled with the nozzle and configured to rotate around the nozzle, the ring-shaped body including blocking segments that block the flow of the air and openings between the blocking segments that permit the air to flow through the ring-shaped body, wherein the ring-shaped body is configured to rotate relative to the nozzle to change how many of the flow passages in the nozzle are blocked by the blocking segments of the ring-shaped body.

2. The nozzle assembly of claim 1, wherein the ring-shaped body is configured to be rotated relative to the nozzle to change which of the flow passages in the nozzle that the air flows through to the turbine blades.

3. The nozzle assembly of claim 1, wherein the ring-shaped body includes opposite first and second rings spaced apart from each other along a center axis of the ring-shaped body, wherein the blocking segments of the ring-shaped body extend from the first ring to the second ring in directions that are parallel to the center axis of the ring-shaped body.

4. The nozzle assembly of claim 3, wherein each of the openings of the ring-shaped body are disposed between and framed by the first and second rings and different pairs of the blocking segments of the ring-shaped body.

5. The nozzle assembly of claim 1, wherein the nozzle has an inner surface and an opposite, outer surface on which the ring-shaped body rotates relative to the nozzle.

6. The nozzle assembly of claim 1, wherein the nozzle has an outer surface and an opposite, inner surface on which the ring-shaped body rotates relative to the nozzle.

7. The nozzle assembly of claim 1, wherein the flow passages through the nozzle are centered on and elongated along non-radial, non-tangential directions relative to an outer surface of the nozzle.

8. The nozzle assembly of claim 1, wherein the nozzle has opposite inner and outer surfaces with the flow passages in the nozzle extending from the outer surface to the inner surface, wherein the flow passages include at least first and second sets of the flow passages through which the air flows through the nozzle, the flow passages in the first set centered around and extending from the outer surface to the inner surface along first non-radial, non-tangential directions, the flow passages in the second set centered around and extending from the outer surface to the inner surface along second non-radial, non-tangential directions that are transversely oriented with respect to the first non-radial, non-tangential directions.

9. The nozzle assembly of claim 1, wherein the flow passages through the nozzle include first and second sets of the flow passages with the flow passages in the first set centered on and extending along first directions oriented at a first angle with respect to an outer surface of the nozzle and the flow passages in the second set centered on and extending along different, second directions oriented at a different, second angle with respect to the outer surface of the nozzle.

10. The nozzle assembly of claim 9, wherein the blocking segments and the openings of the ring-shaped body are positioned to block the air from flowing through the flow passages in the first set of the nozzle and to allow the air to flow through the flow passages in the second set of the nozzle when the ring-shaped body is in a first location relative to the nozzle, and wherein the blocking segments and the openings of the ring-shaped body are positioned to block the air from flowing through the flow passages in the second set of the nozzle and to allow the air to flow through the flow passages in the first set of the nozzle when the ring-shaped body is in a different, second location relative to the nozzle.

11. The nozzle assembly of claim 1, further comprising an actuation assembly configured to be coupled with the ring-shaped body and configured to move the ring-shaped body around the nozzle.

12. An airflow restriction body of a turbocharger, the airflow restriction body comprising:

a first ring configured to be coupled with a nozzle of the turbocharger;

a second ring configured to be coupled with the nozzle of the turbocharger, the second ring spaced apart from the first ring in a direction that is parallel to a center axis of the nozzle of the turbocharger; and blocking segments extending from the first ring to the second ring and spaced apart from each other by openings, wherein the first and second rings and the blocking segments are configured to rotate around the nozzle of the turbocharger to change which flow passages of the nozzle through which air flows from a volute housing of the turbocharger to blades of the turbocharger are open and which of the flow passages are closed.

13. The airflow restriction body of claim 12, wherein the blocking segments extend from the first ring to the second ring in directions that are parallel to the center axis of the nozzle.

14. The airflow restriction body of claim 12, wherein each of the openings are disposed between and framed by the first and second rings and different pairs of the blocking segments.

15. The airflow restriction body of claim 12, wherein the first and second rings and the blocking segments are configured to rotate on an outer surface of the nozzle.

16. The airflow restriction body of claim 12, wherein the first and second rings and the blocking segments are configured to rotate on an inner surface of the nozzle.

17. A method comprising:

determining a load placed on one or more of an engine or a turbocharger operatively coupled with the engine; and rotating a ring-shaped body around a nozzle of the turbocharger based on the load that is determined, the ring-shaped body having blocking segments that block at least some flow passages of the nozzle through which air flows from a volute housing of the turbocharger to blades of the turbocharger and openings that allow the air to flow from the volute housing of the turbocharger to the blades of the turbocharger, wherein rotation of the ring-shaped body blocks the air from flowing through at least some of the flow passages in the nozzle with the blocking segments of the ring-shaped body.

18. The method of claim 17, further comprising rotating the ring-shaped body to move the blocking segments away from the flow passages of the nozzle responsive to an increase in the load placed on the one or more of the engine or the turbocharger.

19. The method of claim 17, wherein rotating the ring-shaped body includes rotating the blocking segments to prevent the air from flowing through the flow passages oriented at a first angle with respect to an outer surface of the nozzle and to allow the air to flow through the flow passages oriented at a different, second angle with respect to the outer surface of the nozzle.

20. The method of claim 17, wherein rotating the ring-shaped body includes rotating the ring-shaped body to block the air from flowing through a set of less than all of the flow passages responsive to the load placed on the one or more of the engine or the turbocharger decreasing and rotating the ring-shaped body to stop blocking the air from flowing through any of the flow passages responsive to the load placed on the one or more of the engine or the turbocharger increasing.

* * * * *